US011523242B1

(12) United States Patent
Osman et al.

(10) Patent No.: US 11,523,242 B1
(45) Date of Patent: Dec. 6, 2022

(54) COMBINED HRTF FOR SPATIAL AUDIO PLUS HEARING AID SUPPORT AND OTHER ENHANCEMENTS

(71) Applicant: Sony Interactive Entertainment Inc., Tokyo (JP)

(72) Inventors: Steven Osman, San Mateo, CA (US); Danjeli Schembri, London (GB)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 17/392,881

(22) Filed: Aug. 3, 2021

(51) Int. Cl.
*H04S 7/00* (2006.01)
*H04R 25/00* (2006.01)

(52) U.S. Cl.
CPC ..... *H04S 7/303* (2013.01); *H04R 25/505* (2013.01); *H04S 2420/01* (2013.01)

(58) Field of Classification Search
None
See application file for complete search history.

(56) References Cited

U.S. PATENT DOCUMENTS

| | | | | |
|---|---|---|---|---|
| 10,003,905 | B1 * | 6/2018 | Milne | H04R 5/04 |
| 2014/0185847 | A1 * | 7/2014 | Gran | H04R 25/405 381/313 |
| 2015/0010160 | A1 * | 1/2015 | Udesen | H04R 25/70 381/60 |
| 2019/0045317 | A1 * | 2/2019 | Badhwar | H04S 7/302 |
| 2020/0178014 | A1 * | 6/2020 | Kim | G06N 3/0454 |
| 2021/0144506 | A1 * | 5/2021 | Milne | G06F 3/0488 |

OTHER PUBLICATIONS

"International Search Report and Written Opinion", dated Sep. 8, 2022 from the counterpart PCT application PCT/US22/73402.

* cited by examiner

*Primary Examiner* — Qin Zhu
(74) *Attorney, Agent, or Firm* — John L. Rogitz

(57) ABSTRACT

A HRTF used for 3D spatialized audio is combined with, e.g., by concatenation, additional settings to provide a more comfortable, accessible, and enjoyable experience for a listener such as a player of a computer game listening to audio through a headset. A single transfer function is thus created that includes the other settings, and once the transfer function is computed the run-time processing can be treated as a single combined transfer function rather than multiple separate stages, resulting in computational savings. The additional settings pertain to hearing aids normally worn by the listener as well as a room-related function specific to a particular listening venue.

19 Claims, 6 Drawing Sheets

Hearing Aid Database

| 1000 Hearing Aid | 1002 Setting | 1004 Transfer Function |
|---|---|---|
| A | 1 | XYZ |
| | 2 | XZY |
| | 3 | YZX |
| B | 1 | LMN |
| | 2 | NML |
| | 3 | KX3 |
| • | | |
| • | | |
| • | | |
| • | | |

FIG. 10

Venue DB

| 1100 Venue | 1102 Transfer Function |
|---|---|
| A | 1 2 3 |
| B | 3 2 4 |
| • | |
| • | |
| • | |

FIG. 11

COMBINED HRTF FOR SPATIAL AUDIO PLUS HEARING AID SUPPORT AND OTHER ENHANCEMENTS

FIELD

The present application relates generally to a combined head-related transfer function (HRTF) that accounts for hearing aids.

BACKGROUND

Binaural or head-related transfer functions (HRTF) are used to modulate the way sounds enter the ear to simulate the effects of real-world variations due to environment, head shape, ear shape, shoulder reflections and so on. As understood herein, people who wear hearing aids will have additional modification performed on this audio to enhance the signal as it is fed into their ear.

SUMMARY

Accordingly, present principles are directed to a combined HRTF that creates a post-hearing aid signal that encompasses not only the head-related modulations but also the enhancements by the hearing aids. This allows people who normally wear hearing aids to remove them and enjoy audio through spatial headphones that already incorporate the functionality of their hearing aids. Metadata extracted from a popular variety of hearing aids and/or a player's specific audiogram taken from hearing tests with different settings may be used to customize HRTFs from images of the ears (or through other methods) to create a custom pair that includes both a personalized HRTF that is further personalized for hearing aid preferences. Additionally, this two-part HRTF can be used for additional functions not just for accessibility. For instance, reverberations and delays can be added to model the player's room or other venue, so that the player can elect to feel as if the sounds they hear are in their own homes/rooms. Thus, by combining features from a set of popular hearing aids as well as 3D Audio HRTFs, a system allows players who wear hearing aids to be able to forego their hearing aids while wearing headphones. Since this is a combined HRTF model, no additional processing would be required beyond 3D spatialized audio processing.

In one aspect, a system includes at least one computer medium that is not a transitory signal and that in turn includes instructions executable by at least one processor to identify a head-related transfer function (HRTF) for a listener. The instructions are executable to receive indication of a hearing aid type associated with the listener, and using the indication, identify a transfer function associated with the hearing aid type. The instructions are executable to modify the HRTF using the transfer function associated with the hearing aid type and then play audio on at least one speaker using the HRTF modified with the transfer function associated with the hearing aid type.

In example embodiments the instructions may be executable to receive indication of at least one venue, identify a transfer function associated with the venue, and modify the HRTF using the transfer function associated with the venue.

In some implementations the instructions are executable to receive indication of at least one setting associated with a hearing aid and using the indication of the hearing aid type associated with the listener and the indication of at least one setting associated with the hearing aid, identify a transfer function associated with the hearing aid type and the at least one setting. In these implementations the instructions are executable to modify the HRTF using the transfer function associated with the hearing aid type and the at least one setting.

The HRTF can be a generic HRTF, or it can be a HRTF personalized to the listener. The audio can be received from a computer game. The HRTF and the transfer function associated with the hearing aid type can be combined through concatenation.

In another aspect, a method includes concatenating a transfer function associated with a hearing aid with a head-related transfer function (HRTF) to render a modified HRTF. The method includes playing computer game audio processed using the modified HRTF using a head-mounted device (HMD) worn by a listener, if desired while the listener is not wearing his or her hearing aids.

In another aspect, an assembly includes at least one head-mounted device (HMD) and at least one processor programmed for processing audio from at least one source of at least one computer simulation through a transfer function comprising a combination of a head-related transfer function (HRTF) and a transfer function associated with a hearing aid for play of the audio on the HMD.

The details of the present application, both as to its structure and operation, can be best understood in reference to the accompanying drawings, in which like reference numerals refer to like parts, and in which:

BRIEF DESCRIPTION OF THE DRAWINGS

FIG. 10 illustrates an example data structure correlating hearing aid type and settings to transfer functions; and FIG. 11 illustrates an example data structure correlating venue to transfer functions.

DETAILED DESCRIPTION

Figure 1:
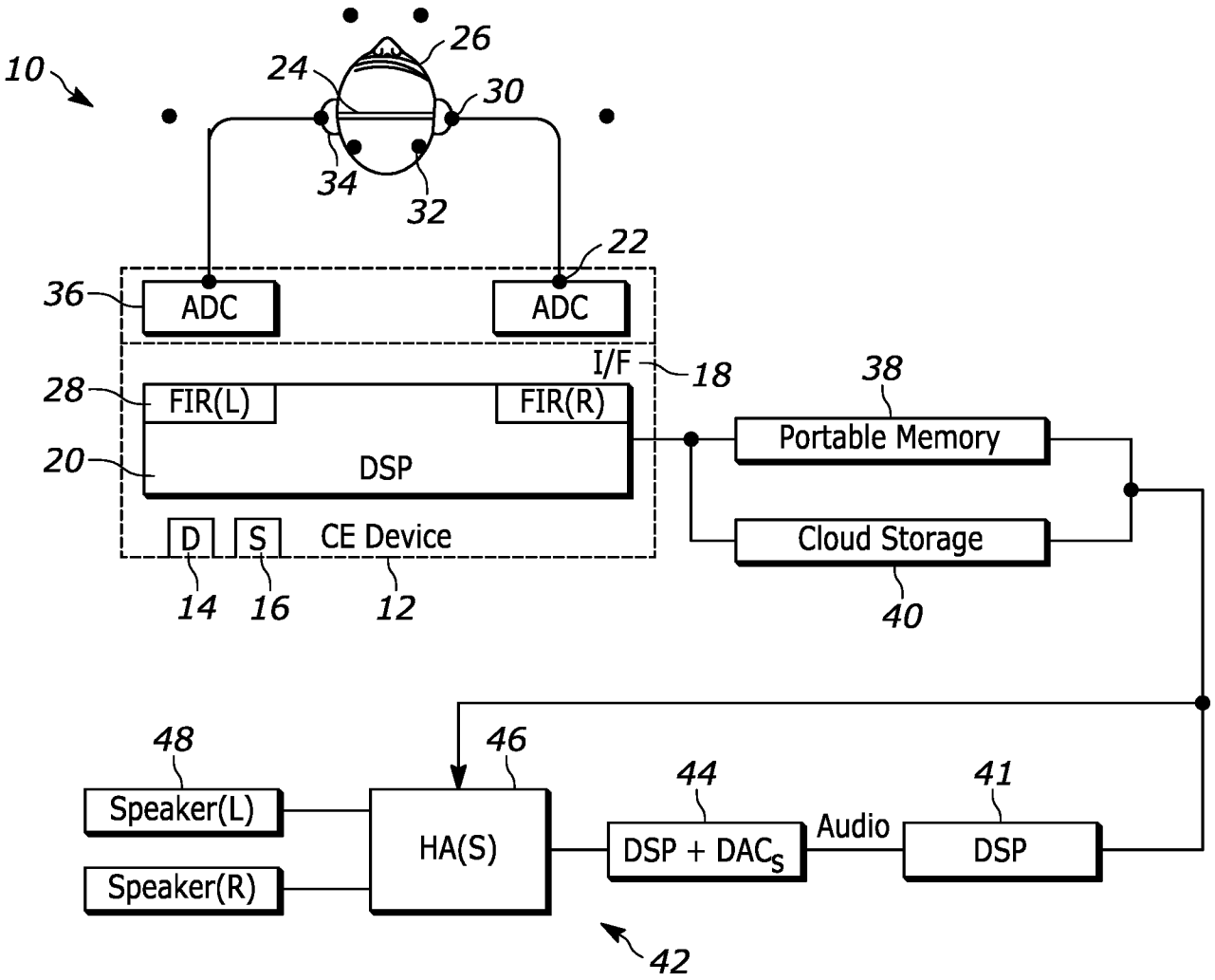
FIG. 1 illustrates an example HRTF recording and playback system.

U.S. Pat. No. 9,854,362 is incorporated herein by reference and describes details of finite impulse response (FIR) filters that can be used for implementing HRTFs. U.S. Pat. No. 10,003,905, incorporated herein by reference, describes techniques for generating head related transfer functions (HRTF) using microphones. U.S. Pat. No. 10,856,097 incorporated herein by reference describes techniques for using images of the ear to generate HRTFs. Co-pending allowed U.S. patent application Ser. No. 16/662,995 incorporated herein by reference describes techniques for modifying a HRTF to account for a specific venue in which sound is played. U.S. Pat. No. 8,520,857, owned by the present assignee and incorporated herein by reference, describes a method for determining HRTF. This patent also describes measuring a HRTF of a space with no dummy head or human head being accounted for.

A HRTF typically includes at least one and more typically left ear and right ear FIR filters, each of which typically includes multiple taps, with each tap being associated with a respective coefficient. By convoluting an audio stream with a FIR filter, a modified audio stream is produced which is perceived by a listener to come not from, e.g., headphone speakers adjacent the ears of the listener but rather from relatively afar, as sound would come from an orchestra for example on a stage that the listener is in front of.

This disclosure accordingly relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g., smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be a single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library. State logic may be employed.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general-purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optic and coaxial wires and digital subscriber line (DSL) and twisted pair wires.

Components included in one embodiment can be used in other embodiments in any appropriate combination. For example, any of the various components described herein and/or depicted in the Figures may be combined, interchanged, or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV), a computer game console, a computer game controller. It is to be understood that the CE device 12 is an example of a device that may be configured to undertake present principles (e.g., communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, and one or more speakers 16 for outputting audio in accordance with present principles. The example CE device 12 may also include one or more network interfaces 18 for communication over at least one network such as the Internet, a WAN, a LAN, etc. under control of one or more processors 20 such as but not limited to a DSP. It is to be understood that the processor 20 controls the CE device 12 to undertake present principles, including the other elements of the CE device 12 described herein. Furthermore, note the network interface 18 may be, e.g., a wired or wireless modem or router, or other appropriate interface such as, e.g., a wireless telephony transceiver, Wi-Fi transceiver, a Bluetooth transceiver, etc.

In addition, to the foregoing, the CE device 12 may also include one or more input ports 22 such as, e.g., a USB port to physically connect (e.g., using a wired connection) to another CE device and/or a head-mounted device (HMD) 24 such as a virtual reality (VR) or augmented reality (AR) HMD or even a speaker-only headphone that can be worn by a person 26. The CE device 12 may further include one or more computer memories 28 such as disk-based or solid-state storage that are not transitory signals on which is stored electronic information such HRTF-related FIR filters.

The CE device 12 may communicate with, via the ports 22 or wireless links via the interface 18, microphones 30 in the earpiece of the HMD 24, speakers 32 in the HMD 24, and hearing aids 34 worn under the HMD 24 to communicate information consistent with disclosure below. It is to be noted that the HMD 24 typically includes additional CE device components mirroring those of the CE device 12 shown in FIG. 1, such as processors, wireless transceivers, and storage that may contain HRTFs for implementation of the HRTFs within the HMD 24 on audio streams received from the CE device 12.

The CE device 12 when implemented by a computer game console is an example source of computer simulations, at least the audio from which can be played on the HMD 24. Another example source of computer simulations such as computer games is a remote game server.

To enable end users to access their personalized HRTF files, the files, once generated, may be stored on a portable memory 38 and/or cloud storage 40 (typically separate devices from the CE device 12 in communication therewith, as indicated by the dashed line), with the person 26 being given the portable memory 38 or access to the cloud storage 40 so as to be able to load (as indicated by the dashed line) his personalized HRTF into a receiver such as a digital signal processor (DSP) 41 of playback device 42 of the end user. A playback device may include one or more additional processors such as a second digital signal processor (DSP) with digital to analog converters (DACs) 44 that digitize audio streams such as stereo audio or multi-channel (greater than two track) audio, convoluting the audio with the HRTF information on the memory 38 or downloaded from cloud storage. This may occur in one or more headphone amplifiers 46 which output audio to at least two speakers 48, which may be speakers of the headphones 24 that were used to generate the HRTF files from the test tones. U.S. Pat. No. 8,503,682, owned by the present assignee and incorporated herein by reference, describes a method for convoluting HRTF onto audio signals. Note that the second DSP can implement the FIR filters that are originally established by the DSP 20 of the CE device 12, which may be the same DSP used for playback or a different DSP as shown in the example of FIG. 1. Note further that the playback device 42 may or may not be a CE device.

In some implementations, HRTF files may be generated by applying a finite element method (FEM), finite difference method (FDM), finite volume method, and/or another numerical method, using 3D models to set boundary conditions.

Figure 2:
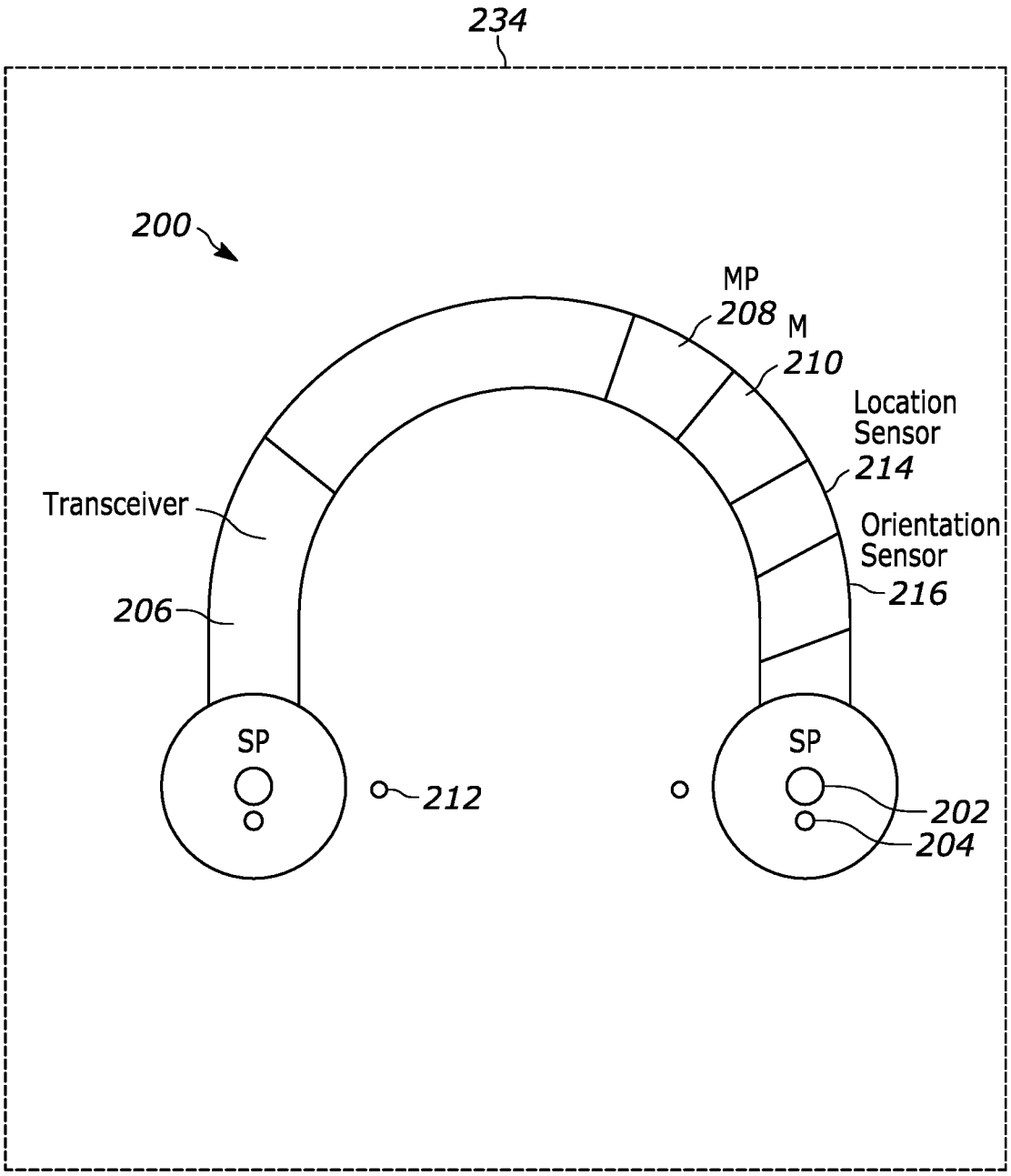
FIG. 2 illustrates an example HMD.

FIG. 2 shows a non-limiting example HMD 200 with left and right earphone speakers 202. In lieu of or adjacent to each speaker 202 may be a respective microphone 204. In the example shown, the HMD 200 may include one or more wireless transceivers 206 communicating with one or more processors 208 accessing one or more computer storage media 210. Hearing aids 212 may be worn independently or with the HMD 200. The HMD 200 may include one or more position or location sensors 214 such as global positioning satellite (GPS) receivers and one or more pose sensors 216 such as a combination of accelerometers, magnetometers, and gyroscopes to sense the location and orientation of the HMD in space.

Present principles may be executed by any one or more of the processors described herein lone or working in concert with other processors.

In general, a personalized HRTF is first derived for a person using techniques described herein as may be augmented by description in one or more of the patent documents incorporated herein by reference, and then the personalized HRTF is modified to account for additional settings. These additional settings can include enhancements provided by a hearing aid, emulation of a specific (famous) environment, or emulation of the player's own home environment. In the latter two cases a data structure specific to a specific venue as described herein and as modified or augmented by one or more of the referenced patent documents herein is combined with, e.g., through concatenation, with a HRTF.

Figure 3:
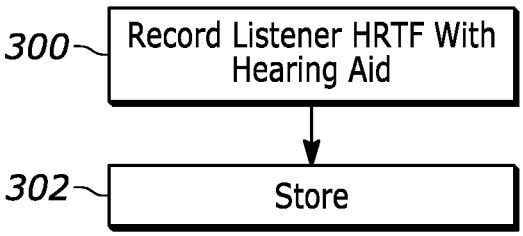
FIG. 3 illustrates example logic in example flow chart format for determining a personalized HRTF.

Refer now to FIG. 3 for a first embodiment. At block 300 a listener's HRTF is recorded with the listener's hearing aids being worn by the listener. The HRTF is stored at block 302. This is a first example of determining a personalized HRTF for the listener. Techniques are described in various of the referenced patent documents for determining a person's HRTF in, e.g., an anechoic chamber with multiple speakers spaced around the chamber to emit test tones which are detected by microphones in the person's ear (in this case, microphones of the hearing aid if desired) the outputs of which are provided to a computer to determine the HRTF. Equivalently, a chamber may have multiple microphones spaced around the chamber to detect test tones which are emitted by speakers in the person's ear (in this case, speakers of the hearing aid if desired) the outputs of which are provided to a computer to determine the HRTF. In other embodiments, images of the person's ears may be used to estimate a personalized HRTF.

In other embodiments, instead of placing the person in a specialized chamber, the person can have his or her hearing aid transfer function recorded using a small speaker near the input end of the hearing aid and a small microphone near the output end, with the emitted signals from the speaker and detected signals from the microphone along with timing information provided to a computer to determine HRTF along the lines of determining HRTF while in an anechoic chamber.

Figure 4:
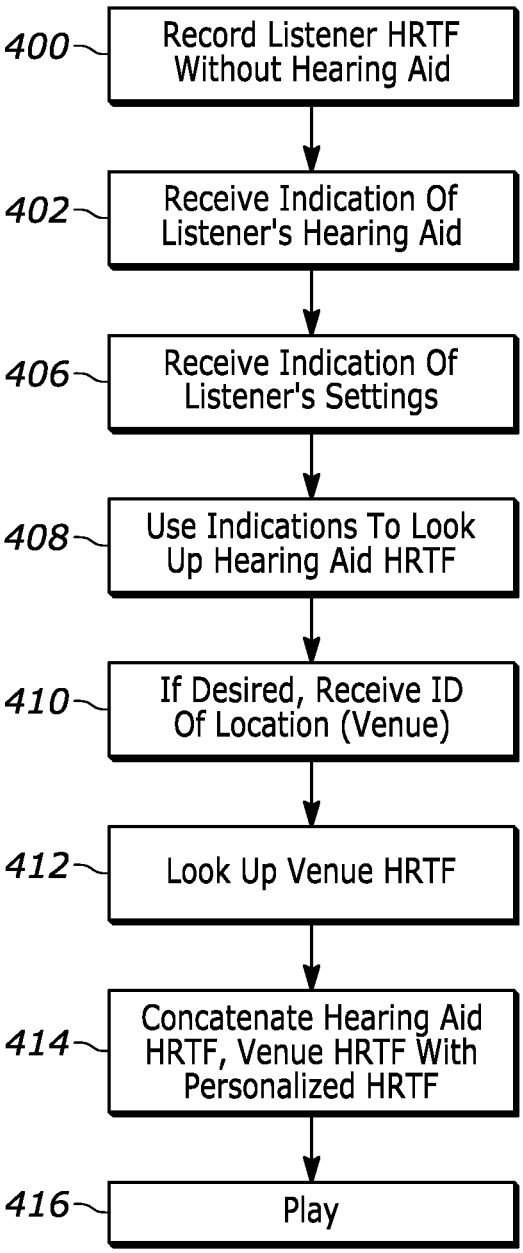
FIG. 4 illustrates alternative example logic in example flow chart format for determining a personalized HRTF that accounts for a hearing aid normally worn by the listener.

FIG. 4 illustrates a more listener-convenient approach that uses a database of common hearing aids. A personalized listener HRTF (or generic listener HRTF if desired) is recorded at block 400, preferably without a hearing aid in place in the listener's ears. This may be done using images of the listener's ears or by other techniques as described herein and in the referenced patent documents. The HRTF typically is a 3D audio HRTF.

Moving to block 402, an indication of the type of hearing aid used by the listener is received. Proceeding to block 404, if desired an indication of the preferred settings the listener establishes for his or her hearing aid is received.

From block 406 the logic moves to block 408 to use the indications received at blocks 402 and 404 to identify a transfer function associated with the hearing aid type ad listener settings, such as by looking up the transfer function in a database using hearing aid type and settings as entering argument. This database may include expertly captured functions at various settings of the hearing aids.

If desired, an identification of a specific venue in which it is desired to model audio being played in may be received at block 410. The venue may be selected from among a list of amphitheaters, stages, famous buildings (such as the Old Vic or Sadler's Wells theatres or Carnegie Hall), parks (such as Hyde Park in London), etc. Or, the venue may be a room in the listener's own home in which the listener typically enjoys listening to audio.

Select of the above-referenced patent documents describe generating a venue-specific transfer function using microphones on a "dummy" head and emitting test tones from speakers located around the venue. The venue-specific transfer function is accessed at block 412.

Proceeding to block 414, the hearing aid transfer function and, when used, the venue-specific transfer function are merged with the listener HRTF from block 400. The various transfer functions may be combined by, for example, concatenating the hearing aid transfer function from block 408 with the HRTF at block 400. Similarly, the venue-specific transfer function from block 412 may be concatenated with the HRTF from block 400. Audio is played at block 416 on, e.g., headphones or other HMD worn by the listener without the hearing aids in place in the listener's ears by passing the audio through the combined transfer function from block 414.

Figure 5:
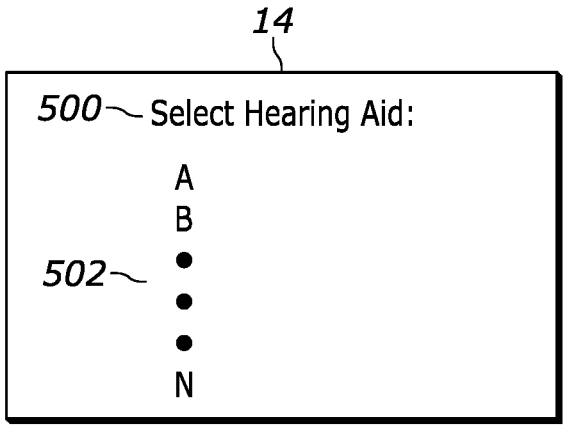
FIGS. 5-7 illustrate example screen shots of user interfaces (UI) consistent with FIG. 4.
Figure 6:
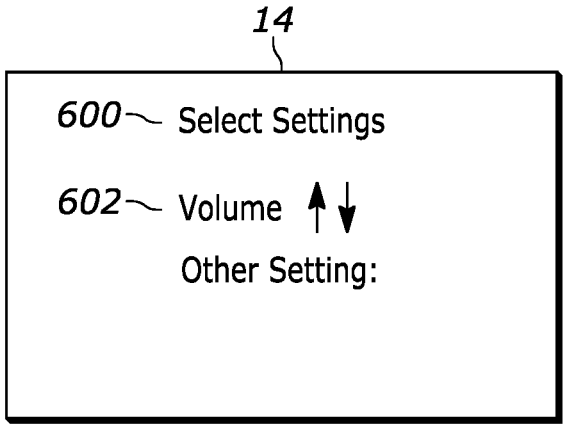
Figure 7:
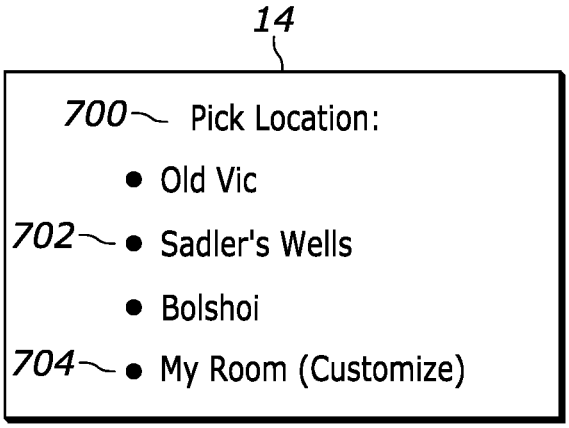

FIGS. 5-7 illustrate screen shots of user interfaces (UI) that may be presented on any display of any device described herein, such as the display 14 in FIG. 1. The UIs may be separate as shown or combined into a single UI. The UIs may be visual as shown or may be audio and/or a combination of audio visual.

The listener may be prompted at 500 in FIG. 5 to select a hearing aid from a list 502. The listener also may be prompted at 600 in FIG. 6 to indicate the listener's preferred hearing aid settings (such as volume 602). When venue-specific transfer functions are desired, the listener may be prompted at 700 in FIG. 7 to select a venue from a list 702. The list 702 may include a customizable option 704 to generate and select a transfer function related to a room of the listener.

Figure 8:
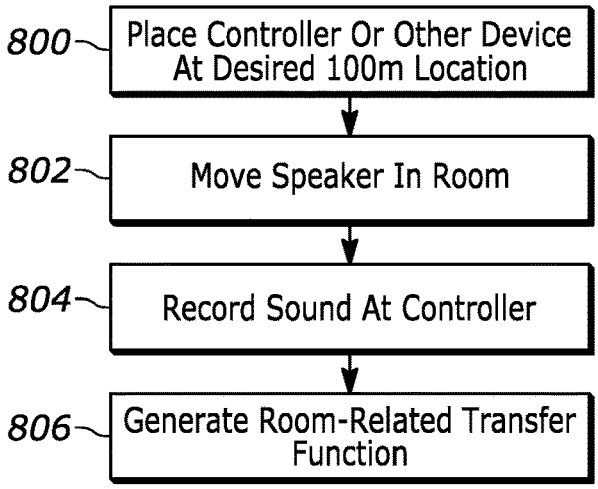
FIG. 8 illustrates example logic in example flow chart format for determining a transfer function related to the listener's room.

Refer now to FIG. 8 for further details regarding this latter selection at 704 in FIG. 7. To generate a transfer function of his or her own room, a listener may, at block 800, place a CE device such as a computer game controller at a location in the room where the listener typically is situated while listening to audio. A sound emitting device (such as a mobile telephone) may be moved around the room at block 802. The sound emitting device may be tracked while moving (e.g., using computer vision implemented on images from a camera on the controller or using GPS information from the sound emitting device), emitting sounds, with detection signals from the controller being recorded at block 804 and used at block 806 in connection with the sound emitting and location information from the phone (synchronized with each other by timestamps) to create a transfer function that models the player's environment.

Figure 9:
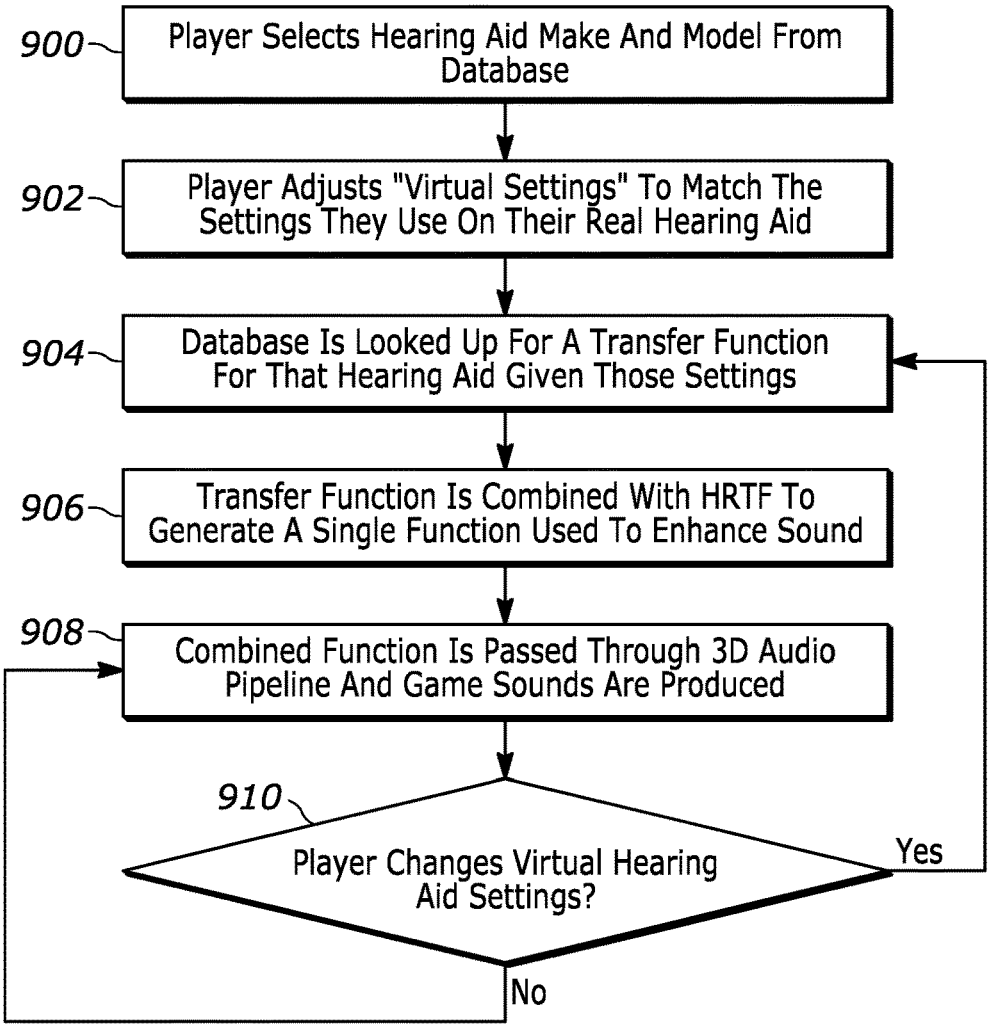
FIG. 9 illustrates alternative example logic in example flow chart format for determining a personalized HRTF that accounts for a hearing aid normally worn by the listener, along the lines of the logic of FIG. 4.

FIG. 9 illustrates another view of the logic of FIG. 4. Commencing at block 900, a listener (referred to in FIG. 9 as a "player" in reference to the listener employing present principles to enjoy audio from a computer simulation such as a computer game) selects the hearing aid type (such as by make and model) from a list of stored hearing aids. At block 902 the listener identifies preferred settings of his or her hearing aid, as by adjusting virtual settings in the UI of FIG. 6 as the listener would do in his or her physical hearing aid.

Moving to block 904, using the identified hearing aid type and settings a data structure such as a database is accessed to look up a corresponding transfer function. At block 906 the transfer function is combined with a generic or personalized HRTF as described above to generate a single function for enhancing audio. The combined transfer function is passed at block 908 through a 3D audio pipeline to produce audio such as computer game sounds.

Decision diamond 910 indicates that in the event the listener changes settings of the virtual hearing aid, e.g., from FIG. 6, the logic may loop back to block 904 to identify a new transfer function.

FIG. 10 illustrates an example data structure in which each of a plurality of hearing aid models in a column 1000 may be associated with multiple different settings in a column 1002, with each hearing aid model setting being associated with a respective transfer function from a column 1004.

FIG. 11 illustrates an example data structure in which each of a plurality of venues in a column 1100 is associated with a respective transfer function from a column 1102.

While the particular embodiments are herein shown and described in detail, it is to be understood that the subject matter which is encompassed by the present invention is limited only by the claims.

What is claimed is:

1. A system comprising:

at least one computer medium that is not a transitory signal and that comprises instructions executable by at least one processor to:

identify a head-related transfer function (HRTF) for a listener;

receive indication of a hearing aid type associated with the listener;

using the indication, identify a transfer function associated with the hearing aid type;

modify the HRTF using the transfer function associated with the hearing aid type; and play audio on at least one speaker using the HRTF modified with the transfer function associated with the hearing aid type.

2. The system of claim 1, wherein the instructions are executable to:

receive indication of at least one venue;

identify a transfer function associated with the venue; and modify the HRTF using the transfer function associated with the venue.

3. The system of claim 1, wherein the instructions are executable to:

receive indication of at least one setting associated with a hearing aid;

using the indication of the hearing aid type associated with the listener and the indication of at least one setting associated with the hearing aid, identify a transfer function associated with the hearing aid type and the at least one setting; and modify the HRTF using the transfer function associated with the hearing aid type and the at least one setting.

4. The system of claim 1, wherein the HRTF is a generic HRTF.

5. The system of claim 1, wherein the HRTF is a HRTF personalized to the listener.

6. The system of claim 1, wherein the audio is received from a computer game.

7. The system of claim 1, wherein the instructions are executable to:

modify the HRTF using the transfer function associated with the hearing aid type by concatenating the HRTF and the transfer function associated with the hearing aid type.

8. The system of claim 2, wherein the venue comprises a room and the instructions are executable to identify the transfer function associated with the venue at least in part by:

receiving signals from a computer game controller situated at a location in the room;

receiving signals from a speaker being moved around the room while the speaker is playing audio; and at least in part using the signals from the controller and the speaker, generating the transfer function associated with the venue.

9. A method comprising:

identifying a hearing aid type;

identifying a transfer function associated with the hearing aid type;

concatenating the transfer function associated with the hearing aid type with a head-related transfer function (HRTF) to render a modified HRTF; and playing computer game audio processed using the modified HRTF using a head-mounted device (HMD) worn by a listener.

10. The method of claim 9, comprising playing the computer game audio processed using the modified HRTF using the HMD worn by the listener without the listener wearing hearing aids.

11. The method of claim 9, wherein the transfer function associated with the hearing aid is a first transfer function associated with a first setting of the hearing aid and the method comprises accessing a second transfer function associated with a second setting of the hearing aid responsive to a change from the first setting to the second setting.

12. The method of claim 9, comprising modifying the HRTF using a transfer function associated with a venue.

13. The method of claim 12, wherein the transfer function associated with the venue determined at least in part using signals from a computer game controller.

14. An assembly comprising:

at least one head-mounted device (HMD); and at least one processor programmed for:

identifying a hearing aid type;

identifying a transfer function associated with the hearing aid type;

processing audio from at least one source of at least one computer simulation through a transfer function comprising a combination of a head-related transfer function (HRTF) and the transfer function associated with the hearing aid type for play of the audio on the HMD.

15. The assembly of claim 14, wherein the processor is in the HMD.

16. The assembly of claim 14, comprising the source, wherein the processor is in the source.

17. The assembly of claim 14, wherein the processor is programmed for:

receiving indication of at least one venue;

identifying a transfer function associated with the venue; and modifying the HRTF using the transfer function associated with the venue.

18. The assembly of claim 14, wherein the processor is programmed for:

receiving indication of at least one setting associated with the hearing aid; and using the indication of the hearing aid type associated with the listener and the indication of at least one setting associated with the hearing aid, identifying the transfer function associated with the hearing aid.

19. The assembly of claim 14, wherein the HRTF is personalized to the listener.

* * * * *